US006498312B1

(12) United States Patent
Villain

(10) Patent No.: US 6,498,312 B1
(45) Date of Patent: Dec. 24, 2002

(54) TWO-PRESSURE SWITCH

(75) Inventor: Jean-Christophe Villain, Paris (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/618,840

(22) Filed: Jul. 18, 2000

(30) Foreign Application Priority Data

Jul. 19, 1999 (FR) ..... 99 09340

(51) Int. Cl.[7] ..... H01H 1/56
(52) U.S. Cl. ..... 200/510; 200/406
(58) Field of Search ..... 200/1 B, 406, 200/510

(56) References Cited

U.S. PATENT DOCUMENTS 4,659,881 A 4/1987 Dowe
5,245,147 A 9/1993 Kobayashi
5,313,027 A * 5/1994 Inoue et al. ..... 200/5 A
5,510,584 A 4/1996 Norris
5,726,400 A 3/1998 Masuda
5,898,147 A * 4/1999 Domzalski et al. ..... 200/1 B
5,952,629 A * 9/1999 Yoshinaga et al. ..... 200/5 A

* cited by examiner

*Primary Examiner*—Lincoln Donovan
*Assistant Examiner*—Lisa N. Klaus
(74) *Attorney, Agent, or Firm*—Sughrue Mion, PLLC

(57) ABSTRACT

A press switch comprises an insulating substrate with two conductive zones suitable for triggering first and second functions, respectively. The first zone has at least two portions that are electrically insulated from each other. A spring has two contact zones, one of which includes at least two regions that are electrically interconnected and suitable for making contact with respective portions. In a rest position, the spring makes contact with at least part of the first conductive zone, and no function is performed. In a first actuated position, a first amount of pressure applied to the spring causes it to make full contact with the first conductive zone, thereby causing the first function to be performed. In a second actuated position, a second amount of pressure causes contact to be made by each contact zone with the respective conductive zone, and the said function is performed.

20 Claims, 4 Drawing Sheets

TWO-PRESSURE SWITCH

The invention relates to a press switch for controlling at least two functions in response to respective pressures exerted on the switch.

BACKGROUND OF THE INVENTION

Such a switch is used for various types of electrical equipment, such as cameras, video cameras, or telephones, for example. The purpose of such a switch is specifically to minimize the number of keys in such equipment, or to make it more ergonomic.

With this type of switch, a first press at lower pressure actuates a first function, for example a preparatory mode such as preselection. Thereafter, a second press at higher pressure serves to actuate a second function, for example an operating mode such as validating the preselection.

Document U.S. Pat. No. 5,313,027 discloses a switch of the above type comprising an insulating substrate having an outer annular contact zone and an inner annular contact zone. A deformable conductive cup disposed in register with said zones is adapted to be in contact firstly with the outer zone on being subjected to a first pressure and secondly with both zones on being subjected to a greater pressure. The cup is covered in an insulating membrane which is fixed to the substrate by means of spacers so as to hold the cup away from the zones in a rest position.

That switch suffers from various drawbacks. Not only are additional pieces necessary for keeping the cup out of contact with the substrate, but it is also difficult to master the amount of space that is required between the cup and the substrate in such a situation. The edges of the cup must lie in a plane that is parallel to the substrate so that the contact due to the first pressure is complete contact.

Furthermore, the fixing of the cup to the membrane is complex and must be perfectly done for proper operation.

There also exist switches comprising a pair of cups disposed one above the other so that on a first pressure, the outer cup urges the inner cup into contact with the outer zone of the substrate, and a second pressure causes the inner cup also to come into contact with the inside zone.

Such a solution is difficult to implement and does not make for a switch that is compact, in particular because of the presence of the two cups.

OBJECTS AND SUMMARY OF THE INVENTION

An object of the invention is thus to mitigate the drawbacks of the prior art by proposing a switch that provides high performance, that is simple to implement, and that is compact, the switch being capable of being used in ergonomic manner to give access to different functions.

To this end, the invention proposes a press switch of the above-specified type, comprising an insulating substrate with at least first and second conductive zones suitable for triggering first and second functions, respectively. At least the first conductive zone has at least two portions that are electrically insulated from each other, a first portion being connected to an inlet track and a second portion to an outlet track. The second conductive zone is also connected to at least one additional outlet track.

The switch also comprises a spring having at least first and second contact zones suitable for coming into contact respectively with the first and second conductive zones as a function of the amount of pressure exerted on the spring. The first contact zone has at least two regions that are electrically interconnected and suitable respectively for coming into contact with the portions so as to interconnect the inlet and outlet tracks.

The spring can take up at least three positions:

- a rest position in which it is in contact with part of at least the first conductive zone, the inlet track being connected to none of the outlet tracks and no function being performed;
- a first actuated position in which a first amount of pressure causes a connection to be established between the inlet track and the outlet tracks of the first conductive zone, said first actuated position being for triggering performance of the first function; and
- a second actuated position in which a second amount of pressure, greater than the first, causes contact to be established between each contact zone with the corresponding conductive zone, said second actuated position being for triggering performance of the second function.

The invention also provides electrical equipment including an above-mentioned press switch, and means for performing at least a first function and a second function, with performance of the functions being triggered in response to respective pressures exerted on the switch.

The function triggered in the first actuated position is, for example, a preselection function, while the function triggered in the second actuated position is, for example a selection function.

In a particular embodiment, the insulating substrate has two conductive zones each occupying a substantially circular ring, the first conductive zone lying outside the second conductive zone.

In a first embodiment, the first conductive zone has at least three portions including a first portion connected to an inlet track and second and third portions connected via outlet tracks to circuits that are programmed so that the first function can be triggered as soon as all three portions have come into contact with the corresponding regions.

In a second embodiment, the first conductive zone has at least three portions, of which a first portion is connected to an inlet track and the second and third portions are connected via outlet tracks to circuits programmed so that a first action can be triggered when the first and second portions are brought into contact, while a second action can be triggered when the first and third portions are brought into contact.

In this situation, the electrical equipment can have means for preforming at least two actions enabling a cursor to be moved in two different directions, in response to actuation of the switch.

The switch can then form part of a navigation button.

At least a portion of the outside face of the spring adheres to a flexible holding membrane adjacent to the insulating substrate outside the conductive zones. This membrane holds the spring in the rest position while enabling it to move to occupy the first and second actuated positions.

The switch of the invention also comprises a key suitable for acting on the outside face of the spring so as to exert the pressures thereon.

BRIEF DESCRIPTION OF THE DRAWINGS

The invention will be better understood in the light of the following detailed description made with reference to the accompanying drawings.

Figure 10:
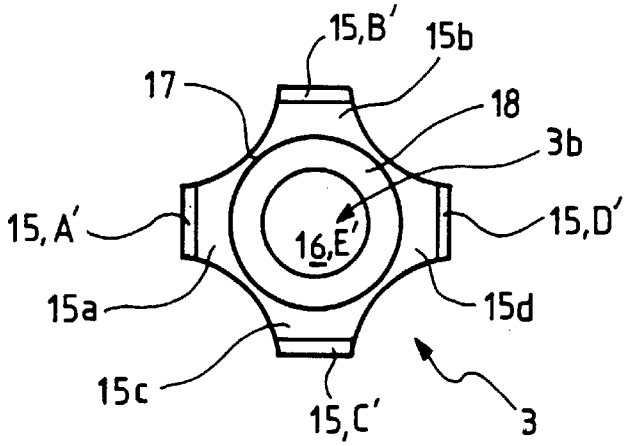

Finally,

FIG. 10 is a diagrammatic view from beneath showing the spring and the contact zones.

MORE DETAILED DESCRIPTION

Figure 1:
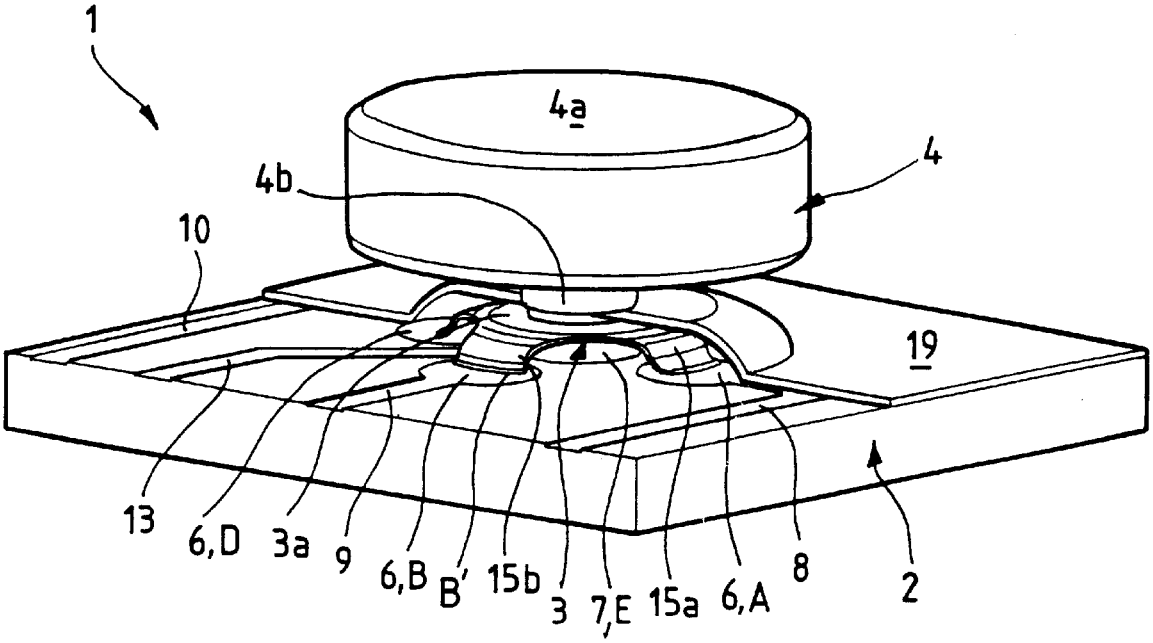
FIGS. 1 and 2 are diagrammatic perspective views of the press switch of the invention, FIG. 1 showing part of the flexible holding membrane.
Figure 2:
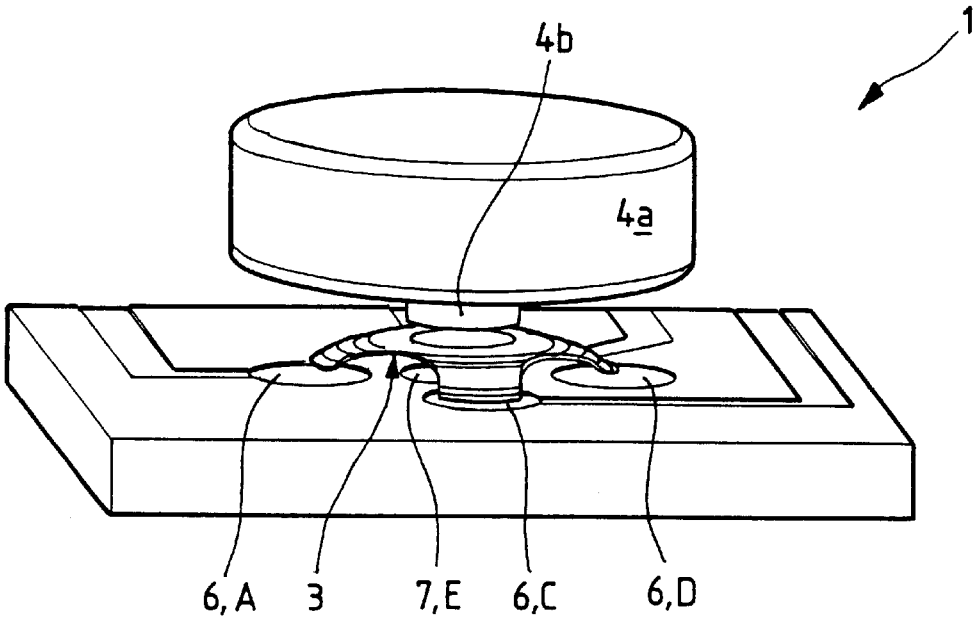

With reference in particular to FIGS. 1 and 2, the switch 1 comprises an insulating substrate 2 having electrical circuits and tracks, and surmounted by a spring 3 suitable for making contact with the electrical circuits.

To make such contact, the spring 3 is moved and deformed under the effect of pressure exerted on the outside face 3*a* thereof by a key 4.

Each of the elements forming the switch 1 of the invention is described below in detail.

Figure 3:
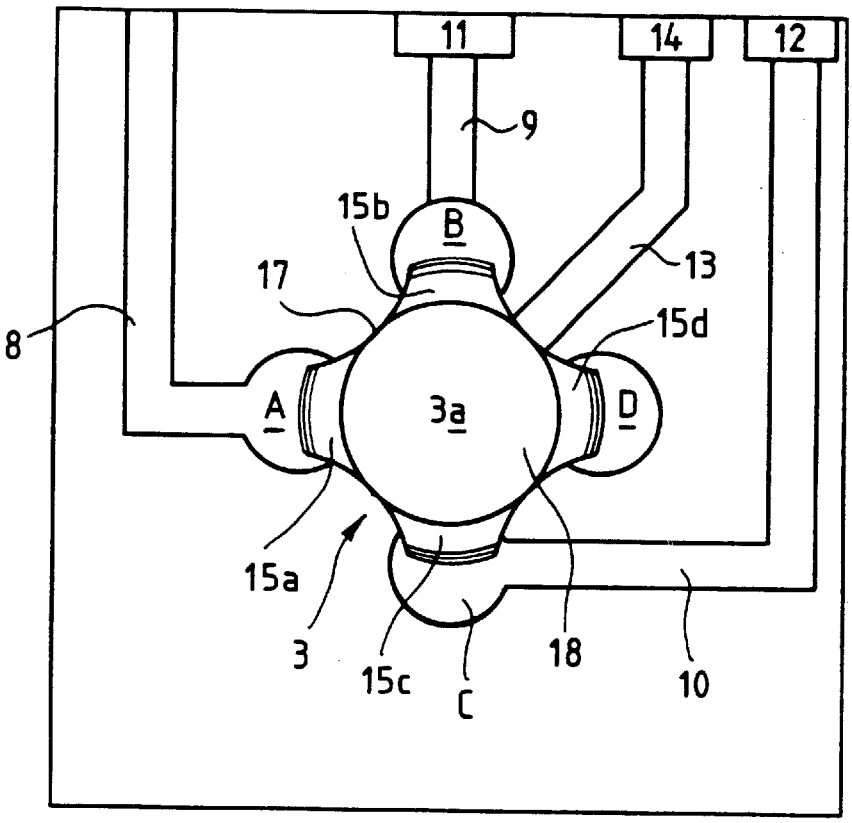
FIG. 3 is a plan view of the insulating substrate surmounted by the spring.
Figure 4:
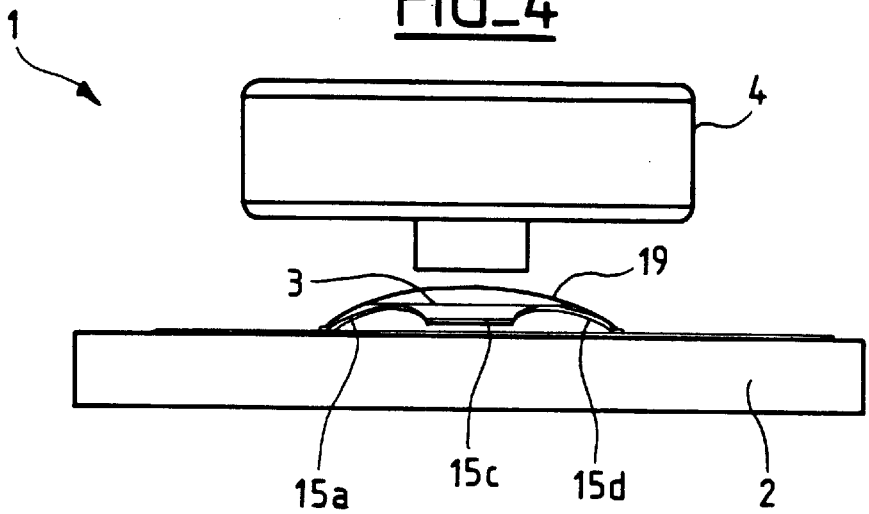
FIGS. 4 and 5 are respectively a side view and a plan view of the press switch of the invention while it is in the rest position.

As shown in FIGS. 1 to 3, the insulating substrate 2 is formed by a plate having first and second conductive zones 6 and 7 each lying within a respective substantially circular annulus. The first conductive zone 6 lies outside the second conducive zone 7.

The first conductive zone 6 comprises four conductive portions A, B, C, and D which are electrically insulated from one another.

Each of these portions A, B, C, and D is generally in the shape of a disk. Naturally, other shapes could be envisaged.

The portions A to D are distributed circumferentially around the ring forming said first conductive zone 6, and in the present embodiment, they are at constant spacing so as to be about 90° from one another.

The first portion A is connected to an inlet track 8 suitable for supplying it with electricity.

The second and third portions B and C which are disposed on either side of the first portion A are connected via respective outlet tracks 9 and 10 to respective particular electrical circuits 11, 12.

Finally, the fourth portion D which is opposite the first portion A is electrically inactive. It is not connected to any circuit.

Figure 5:
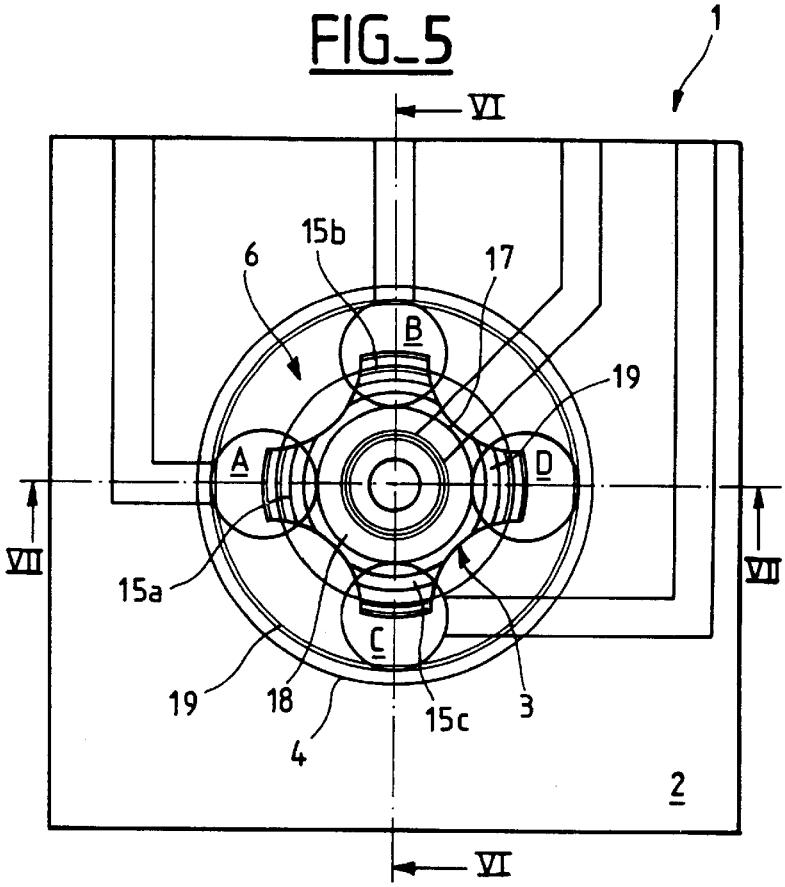

Thus, the first and fourth portions A and D are in alignment on a plane substantially perpendicular to the plane along which the second and third portions B and C are in alignment (see FIGS. 3 and 5).

The electrical circuits 11 and 12 are programmed so that when contact is established simultaneously with each of the portions A to D, then a first function is performed.

By way of example, this function is preselection in a menu which can be displayed on a screen (not shown) connected to the switch 1.

In a variant embodiment, the electrical circuit 11 can be programmed so that a first action is performed when contact is established simultaneously between the portions A, B, and D. In addition, the electrical circuit 12 can be programmed so that a second action is performed when contact is established simultaneously between portions A, C, and D.

In this situation, provision can be made for these actions to form parts of a preselection function and enable a cursor to be moved in two different directions (e.g. up and down), with the cursor being movable through a menu displayed on a screen, for example. The switch 1 can then be integrated in a navigation button.

Naturally, other functions or actions could be provided.

Alternatively, the portion D could be eliminated or indeed other portions could be added suitable for triggering other functions or actions.

The second conductive zone 7 comprises a single portion E of shape and size analogous to the portions A to D.

In the embodiment shown, the portion E is located in the center of the ring having the portions A to D. It is thus at equal distances from all of them.

The portion E is connected via an outlet track 13 to an electrical circuit 14 which is programmed so that when contact is established simultaneously with each of the portions A to E, then a second function is performed.

By way of example, this second function can be a function for enabling a choice that has been preselected by the first function or action.

In variant embodiments, it is possible to envisage that the second function is performed as soon as simultaneous contact is established with portions A, B, D, E or A, C, D, E, assuming that portion D exists. In any event, the second function can be performed only if the portion A which is connected to an electricity inlet track and the portion E are connected simultaneously.

It is also possible to provide for the second conductive zone 7 to have a plurality of portions in the same manner as the first conductive zone 6 so as to enable other functions to be performed.

The spring 3 is in the form of a cup of section that is generally circular. More precisely, it is generally hemispherical in shape.

It is made of a deformable material so as to cause the switch to be statically undetermined. For example, it can be made of a flexible metal by stamping and cutting out.

On its inside face 3*b* which is to face the insulating substrate 2, the spring 3 has first and second contact zones 15 and 16.

As explained below, these contact zones 15, 16 are suitable for making contact respectively with the first and second conductive zones 6 and 7, depending on the pressure exerted on the spring 3.

The first contact zone 15 has four regions A', B', C', and D' which are electrically interconnected and suitable for making contact with the portions A, B, C, and D respectively so as to interconnect the inlet track 8 and the outlet tracks 9 and 10.

As shown in particular in FIG. 10, the portions A' to D' form parts of tabs 15*a* to 15*d* that project from the free edge 17 of the spring 3.

More precisely, the spring 3 is in the form of a hemispherical dome 18 extended from its free edge 17 by four tabs 15*a* to 15*d*.

In the embodiment shown, the spacing between any two adjacent tabs is constant and about 90°.

Each of the tabs 15*a* to 15*d* follows the general curvature of the dome 18.

At their free end portions, the tabs have respective plane surfaces forming the contact regions A' to D'. These surfaces extend in planes that are substantially parallel and they project outwards from the dome 18.

More precisely, the regions A' and D' extend in a first plane while the regions B' and C' extend in a second plane that is substantially parallel to the first plane, the second plane being closer to the top of the dome 18.

In the embodiment shown, the offset between the two planes is about 0.2 millimeters.

In plan view (FIG. 10), the spring 3 is substantially in the form of a four-pointed star.

When the spring 3 is placed on the insulating substrate 2 with its concave side facing towards the conductive zones 6 and 7 and no pressure is applied thereon, the free edge 17 is at a distance from the insulating substrate 2.

Furthermore, in this position, only the mutually opposite tabs 15*a* and 15*d* are resting via their plane surfaces on the insulating substrate 2, and the other tabs 15*b* and 15*c* are spaced apart therefrom. More precisely, the spring 3 is placed in such a manner that the region A' rests on the portion A and the region D' rests on the portion D.

Figure 7:
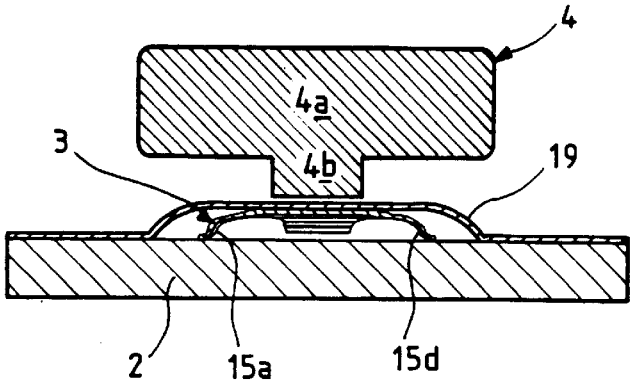
FIGS. 6 and 7 are section views respectively on lines VI—VI and VII—VII of FIG. 5.
Figure 6:
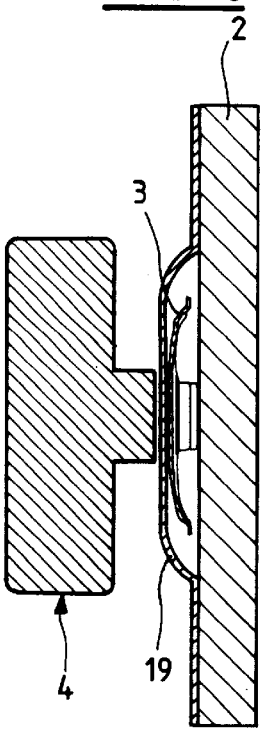

This position of the spring 3 corresponds to its rest position (see FIGS. 5 to 7).

Figure 8:
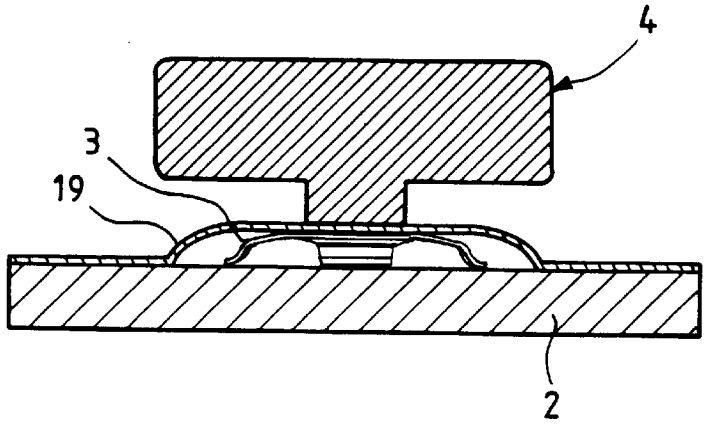

In order for the tabs 15*b* and 15*c* to come into contact with the insulating substrate 2 and thus with the portions B and C respectively, it is necessary to exert a small amount of pressure on the spring 3 to move it away from its rest position. The spring 3 then takes up its first actuated position (see FIG. 8).

Preferably, the offset between the plane including the regions A' and D', and the plane including the regions B' and C' is very small so that the displacement required of the spring 3 to go from the rest position to the first actuated position is small.

The second contact zone 16 has a single contact region E' suitable for coming into contact with the portion E.

The region E' extends in the vicinity of the top of the dome 18. It may also cover the entire bottom face of the dome 18.

This region E' can make contact with the corresponding portion E only when the spring 3 is deformed sufficiently for its concave orientation to be inverted under the effect of sufficient pressure. The spring 3 is then in its second actuated position (see FIG. 9).

In the present embodiment, the spring 3 is made as a single piece of conductive material. It can be made out of an electrically-conductive metal, for example.

Only the inside face 3*b* or only the regions A' to E' need have conductive material, for example they could be covered in conductive material.

The spring 3 is maintained in its rest position by means of a flexible support membrane 19 such as a thin film.

The material of the support membrane 19 must be sufficiently fine and flexible to prevent it deforming the spring 3 in any way. It must make it possible, at least for the spring to go from its rest position to its first and second actuated positions.

By way of example, the support membrane 19 can be made of flexible plastics material or of paper.

The support membrane 19 is rigidly secured, e.g. by adhesive, to at least a portion of the outside face 3*a* (e.g. the outside face of the dome 18), or indeed to the entire outside surface. It thus fits closely to the outside shape of the spring 3.

The support membrane 19 is also rigidly fixed to the insulating substrate 2 away from the conductive zones 6 and 7 (see FIGS. 1 and 5 to 8).

As mentioned above, the spring 3 is actuated by means of a key 4 which is suitable for making contact with the support membrane 19.

In the embodiment shown, the key 4 is in the form of two solid cylinders 4*a* and 4*b* that are superposed via their bases. One of the cylinders 4*a* is of greater diameter than the other.

The small cylinder 4*b* is designed to come into contact via its base remote from the cylinder 4*a* with the support membrane 19 at least in the vicinity of the top of the dome 18. The other cylinder 4*a* is designed for receiving the finger of the user.

The key 4 thus has a cross-section that is T-shaped.

It can be made as a single piece, for example.

Naturally, other shapes of key could be envisaged. For example, in the embodiment for enabling the outer conductive zone 6 to perform two directional actions, provision can be made for the surface that is adapted to receive the finger of the user to be curved so that its concave side is directed outwards so as to facilitate pressing against the zones A, B, and D or A, C, and D.

Where appropriate, movement of the key 4 is guided and constrained by a wall extending substantially parallel to the insulating substrate 2 and engaging said key.

Each of the positions of the above-described switch 1 is described below.

In the rest position, the key 4 does not exert any pressure on the spring 3. It is preferably spaced apart therefrom.

As shown in FIGS. 5 to 7, only the tabs 15*a* and 15*d* are in contact with the first conductive zone 6. Contact is thus made with part of this conductive zone 6. In addition, the tabs 15*b* and 15*c* are spaced apart from the insulating substrate 2.

It will be understood that in this embodiment, the symmetrical disposition of each pair of tabs 15*a*–15*d* and 15*b*–15*c* provides a certain amount of equilibrium and stability to the spring 3 in the rest position.

In a first actuated position, light pressure exerted by the key 4 on the spring 3, or more precisely on the supporting membrane 19, causes the tabs 15*b* and 15*c* to be put into contact with the conductive zone 6, and specifically its portions B and C.

Full contact is then established with said conductive zone 6. A connection is thus established between the inlet track 8 and the outlet tracks 9 and 10, so the first function can be performed.

It should be observed that in this position, the dome 18 is not deformed. All that has happened is that pressure on the top of the dome 18 has enabled the tabs 15*b* and 15*c* to be lowered towards the insulating substrate 2.

Provision could also be made for means that lock the key 4 in this first actuated position, said locking means nevertheless permitting the key to pass on towards the second actuated position.

The symmetry of the tabs 15*b* and 15*c* makes it possible to guarantee simultaneous contact for the tabs 15*b* and 15*c* when appropriate pressure is exerted on the spring 3.

Furthermore, a safety effect is guaranteed. If the spring is poorly fixed (e.g. the plane having the region B' and C' is not exactly parallel to the insulating substrate 2) so that in the rest position a single one of the tabs 15*b* and 15*c* is in contact with the insulating substrate 2, the first function can only be performed after pressure has been applied to the spring 3, and not inadvertently.

Figure 9:
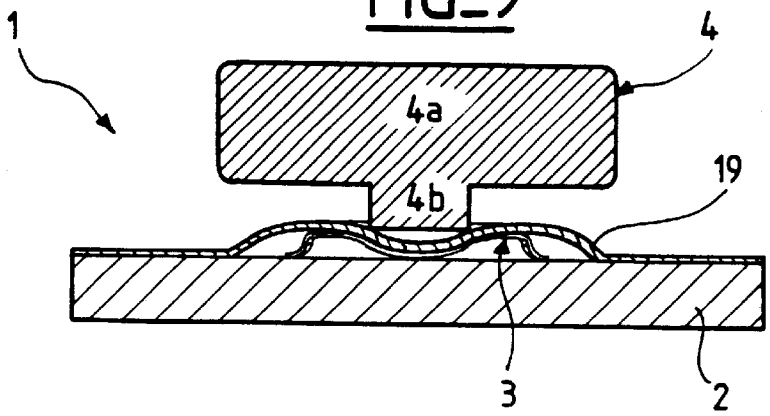
FIGS. 8 and 9 are section views analogous to the view of FIG. 6, respectively showing the first and second actuated positions of the press switch of the invention.

In the second actuated position, the pressure exerted by the key 4 on the spring 3 is greater than before and causes the dome 18 to deform. The concave side of the dome 18 is then inverted so the inside face of the top of the dome comes into contact with the portion E of the second conductive zone 7 (FIG. 9).

It should be observed that the support membrane 19 also follows this deformation.

In this situation, contact with the first conductive zone 6 is complete.

When the key 4 is released, the dome 18 returns automatically to its rest position and the tabs 15*b* and 15*c* are spaced apart from the insulating substrate 2. The spring 3 then returns to its rest position.

Naturally, the invention is not limited to the embodiments described above.

Provision could be made for some different number or some other disposition of the portions A to D in the first conductive zone 6, together with a corresponding different spacing of the tabs 15*a* to 15*d*.

What is claimed is:

1. A press switch for controlling at least two functions in response to respective pressure exerted on the switch, comprising:

an insulating substance having at least first and second conductive zones respectfully suitable for trigging first and second functions, at least the first conductive zone having at least two portions that are eletrically insulated from each other, the first portion being connected to an inlet track and the second portion being connected to an outlet track, the second conductive zone also being connected to at least one additional outlet track;

a single having at least first and contact zones suitable for making contact respectively with the first and second conductive zones as a function of pressure exerted on the spring, the first contact zone having at least two regions that are electrically interconnected and suitable for making contact with respective portions so as to interconnect the inlet and outlet tracks, wherein each region forms a portion of a tab projecting from a free edge of said spring;

the spring being positionable in at least three positions:

a rest position in which it is in contact with part of at least the first conductive zone, the inlet track being connected to none of the outlet tracks and no function being performed;

a first actuated position in which a first amount of pressure causes a connection to be established between the inlet track and the outlet tracks of the first conductive zone, said first actuated position being for triggering performance of the first function; and a second actuated position in which a second amount of pressure, greater than the first, causes contact to be established between each contact zone with the corresponding conductive zone, said second actuated position being for triggering performance of the second function.

2. A press switch according to claim 1, wherein the spring is a deformable cup disposed in such a manner that its concave side faces towards the conductive zones.

3. A press switch according to claim 1, wherein the spring is substantially circular in general section.

4. A press switch according to claim 1, wherein an inside face of the spring facing the conductive zones includes a conductive material.

5. A press switch according to claim 1, wherein the insulating substrate has two conductive zones each occupying a substantially circular ring, the first conductive zone lying outside the second conductive zone.

6. A press switch according to claim 1, wherein the second conductive zone has a single portion.

7. A press switch according to claim 6, wherein the first and second portions of said first conductive zone are disposed on either side of the single portion of said second conductive zone.

8. A press switch according to claim 1, wherein the first conductive zone has at least three portions including a first portion connected to an inlet track and second and third portions connected via outlet tracks to circuits that are programmed so that the first function will be triggered as soon as all three portions have come into contact with the corresponding regions.

9. A press switch according to claim 1, wherein the first conductive zone has at least three portions, of which a first portion is connected to an inlet track and the second and third portions are connected via outlet tracks to circuits that are programmed so that the first function will be triggered when the first and second portions are brought into contact, while a second action will be triggered when the first and third portions are brought into contact.

10. A navigation button, comprising a press switch according to claim 9.

11. A press switch according to claim 1, wherein a flexible support membrane has at least a portion of an outside face of the spring adhering thereto and placed adjacent to the insulating substrate outside the conductive zones, which membrane supports the spring in the rest position while allowing it to pass into its first and second actuated positions.

12. A press switch according to claim 1, further comprising a key suitable for acting on the outside face of the spring so as to exert pressure thereon.

13. Electrical equipment including a press switch according to claim 1, and means for performing at least first and second functions, the performance of the functions being triggered in response to respective pressures exerted on the switch.

14. Electrical equipment according to claim 13, wherein the function triggered in the first actuated position is a preselection function, while the function triggered in the second actuated position is a selection function.

15. Electrical equipment according to claim 13, including means for performing at least two actions in response to the switch being actuated.

16. A press switch according to claim 1, wherein the spring is a deformable cup disposed in such a manner that its concave side faces towards the conductive zones.

17. A press switch for controlling at least two functions in response to respective pressures exerted on the switch, the switch comprising:

an insulating substrate having at least first and second conductive zones respectfully suitable for trigging first and second functions, at least the first conductiive zone having at least two portions that are electrically insulated from each other, the first portion being connected to an inlet track and the second portion being connected to an outlet track, the second conductive zone also being connected to at least one additional outlet track;

a single spring having at least first and second contact zones suitable for making contact respectively with the first and second conductive zones as a function of pressure exerted on the spring, the first contact zone having at least two tabs, whose ends are located in a first plane, that are eletrically interconnected and suitable for making contact with respective portions so as to interconnect the inlet and outlet tracks, wherein an end of said second contact zone is located in a second plane, and said first and second planes are substantially parallel to each other and to a top surface of said single spring;

the spring being positionable in at least three position:

a rest position in which it is in contact with part of at least the first conductive zone, the inlet track being connected to none of the outlet tracks and no function being performed;

a first actuated position in which a first amount of pressure causes a connection to be established between the inlet track and the outlet tracks of the first conductive zone, said first actuated position being for triggering performance of the first function; and a second actuated position in which a second amount of pressure, greater than the first, causes contact to be established between each contact zone with the corresponding conductive zone, said second actuated position being for triggering performance of the second function.

18. A press switch according to claim 17, wherein the first conductive zone has at least three portions including a first portion connected to an inlet track and second and third portions connected via outlet tracks to circuits that are programmed so that the first function will be triggered as soon as all three portions have come into contact with the corresponding regions.

19. A press switch according to claim 17, wherein the first conductive zone has at least three portions, of which a first portion is connected to an inlet track and the second and third portions are connected via outlet tracks to circuits that are programmed so that the first function will be triggered when the first and second portions are brought into contact, while a second action will be triggered when the first and third portions are brought into contact.

20. A press switch according to claim 17, wherein a flexible support membrane has at least a portion of an outside face of the spring adhering thereto and placed adjacent to the insulating substrate outside the conductive zones, which membrane supports the spring in the rest position while allowing it to pass into its first and second actuated positions.

* * * * *